United States Patent [19]

Bowlds et al.

[11] 4,419,024

[45] Dec. 6, 1983

[54] SILICON DIOXIDE INTERMEDIATE LAYER IN THERMAL TRANSFER MEDIUM

[75] Inventors: Patsy A. Bowlds, Paris, Ky.; Bruce M. Cassidy, Fairfax, Va.; Arthur E. Graham, Lexington, Ky.; Robert J. Huljak, Lexington, Ky.; Donald W. Stafford, Lexington, Ky.; Deh C. Tao, Lexington, Ky.

[73] Assignee: International Business Machines Corporation, Armonk, N.Y.

[21] Appl. No.: 333,349

[22] Filed: Dec. 22, 1981

[51] Int. Cl.[3] ..... B41J 31/00

[52] U.S. Cl. ..... 400/120; 400/198; 400/241.1; 428/914

[58] Field of Search ..... 400/118, 119, 120, 198, 400/241.1; 428/448, 473.5, 914

[56] References Cited

U.S. PATENT DOCUMENTS

| | | | |
|---|---|---|---|
| 2,713,822 | 7/1955 | Newman | 101/460 X |
| 2,962,404 | 11/1960 | McIntyre et al. | 428/448 |
| 3,383,235 | 5/1968 | Blackburn et al. | 428/448 X |
| 3,391,023 | 7/1968 | Frescura | 428/448 X |
| 3,744,611 | 7/1973 | Montanari et al. | 400/120 |
| 4,103,066 | 7/1978 | Brooks et al. | 400/120 X |
| 4,196,246 | 4/1980 | Takayama et al. | 428/448 X |
| 4,236,834 | 12/1980 | Hafer et al. | 400/120 |
| 4,253,775 | 3/1981 | Crooks et al. | 400/119 X |
| 4,269,892 | 5/1981 | Shattuck et al. | 400/241.1 X |
| 4,309,117 | 1/1982 | Chang et al. | 400/241.1 |
| 4,345,845 | 8/1982 | Bohnhoff et al. | 400/120 |

FOREIGN PATENT DOCUMENTS

| | | | |
|---|---|---|---|
| 1469392 | 4/1977 | United Kingdom | 400/120 |
| 2022019 | 12/1979 | United Kingdom | 400/120 |

OTHER PUBLICATIONS

*IBM Technical Disclosure Bulletin,* vol. 24, No. 3, Aug. 1981, entitled "Thermal Efficiency Improvement by Anodization" by P. A. Bowlds et al. at pp. 1356–1357.

*Primary Examiner*—Ernest T. Wright, Jr.
*Attorney, Agent, or Firm*—John A. Brady

[57] ABSTRACT

Disclosed is a thermal transfer medium which comprises a mixture of a thermosetting polyimide, a thermoplastic polyimide, and graphite. It has a steel support layer and an intermediate layer of silicon dioxide. An outer layer on the steel is the thermal ink. The mixture is applied as a dispersion with a precursor of the thermosetting polyimide. The ribbon may be recoated at the typing station by applying a hot-melt of the ink.

31 Claims, 1 Drawing Figure

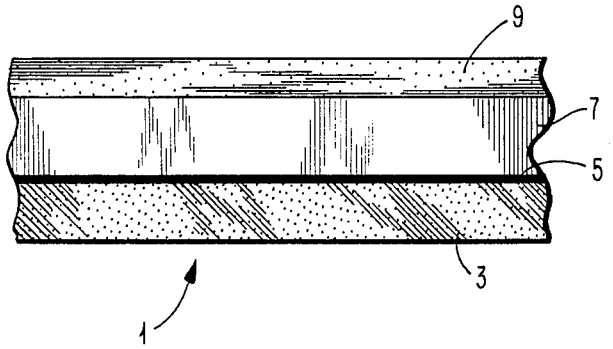
9
7
5
3
1

SILICON DIOXIDE INTERMEDIATE LAYER IN THERMAL TRANSFER MEDIUM

DESCRIPTION

1. Cross Reference to Related Application

Application Ser. No. 333,348, filed Dec. 22, 1981, the same date as this application, entitled "Resistive Substrate for Thermal Printing Ribbons Comprising a Mixture of Thermosetting Polyimide, Thermoplastic Polyimide, and Conductive Particulate Material," by Arthur E. Graham and assigned to the same assignee to which this application is assigned, is directed to a resistive layer which is a blend of a thermosetting polyimide and a thermoplastic polyimide. The preferred embodiment of this invention includes a mixed polyimide resistive layer.

2. Technical Field

This invention is to ribbons for non-impact, thermal printing by resistive heating in the ribbon. Ink is transferred from the ribbon to paper at localized areas at which heat is generated. Localized heating may be obtained, for example, by contacting the ribbon with point electrodes and a broad area contact electrode. The high current densities in the neighborhood of the point electrodes during an applied voltage pulse produce intense local heating which causes transfer of ink from the ribbon to a paper or other substrate in contact with the ribbon.

3. Background Art

Printing by thermal techniques of the kind here of interest is known in the prior art, as shown, for example in U.S. Pat. Nos. 2,713,822 to Newman; 3,744,611 to Montanari et al; and 4,269,892 to Shattuck et al.

The foregoing Montanari and Shattuck patents illustrate the established use of aluminum as an intermediate lamination between the resistive layer and the ink layer. Aluminum is a good electrical conductor and that characteristic is employed as a low-resistance path from the area near the point electrodes to the broad area electrodes.

Aluminum normally spontaneously forms a thin oxide layer on any surface contacted by atmospheric oxygen. For this reason the established use of aluminum necessarily included a very thin layer of aluminum oxide between the resistive layer and the unoxidized, relatively thick internal aluminum in the lamination. A second, very thin layer of aluminum oxide is necessarily on the side of the lamination facing the ink.

Accordingly, during normal use of a thermal ribbon employing the established aluminum layer, the electrical path would be from each point electrode carrying current, through the resistive layer, through a thin aluminum oxide layer contacting the resistive layer and through the low resistance aluminum to the broad area electrode. Aluminum oxide is highly resistive. Current would be carried by the internal aluminum and little would flow through the aluminum oxide layer near the ink. Localized high heating at interface between the aluminum and the resistive layer was apparent to those of ordinary skill working with the ribbon.

*IBM Technical Disclosure Bulletin,* article by P. A. Bowlds and B. M. Cassidy entitled "Thermal Efficiency Improvement By Anodization," at Vol. 24, No. 3, published August 1981, at pages 1356 and 1357 describes anodization of the aluminum layer to produce a high resistance for generating heat near the transfer layer.

This article is by two of the joint inventors of this application.

This invention differs from the prior art by employing a layer of silicon dioxide contacting the resistive layer. The silicon dioxide layer functions to generate heat effective for thermal printing at currents much lower than those required where only a good conductor contacts the resistive layer. The use of aluminum is not significant when this invention is employed and in the preferred embodiment steel is employed as the conductive layer.

DISCLOSURE OF THE INVENTION

In accordance with this invention a transfer medium for thermal printing has a very thin layer of silicon dioxide as a lamination on the resistive layer. The transfer medium will have a heat-flowable layer of marking material on the side opposite the resistive layer.

A typical embodiment has a resistive layer comprising a particulate, conductive filler material and a polymeric binder; a layer of silicon dioxide deposited from a gas state, such as by vacuum deposition; a metal layer contacting the silicon dioxide opposite the resistive layer; and a solid, meltable ink on the other side of the metal layer.

The silicon dioxide is very thin and in the preferred embodiment is about 80 angstroms in depth. At this thickness, it conducts with a high effective resistivity. Electrical heating is correspondingly high at that region, which is nearer to the ink than the internal part of the resistive layer. The resulting effect from the addition of silicon dioxide is greatly increased effective heating for the purposes of thermal printing. In fact, the best mode described below would be impractical and essentially inoperative because of the large currents required if the resistive layer were laminated directly to the steel layer.

BRIEF DESCRIPTION OF THE DRAWING

A preferred embodiment of this invention is described in detail with reference to the accompanying drawing, which shows a side view of the reinkable ribbon.

BEST MODE FOR CARRYING OUT THE INVENTION

The preferred and best embodiment of this invention is a four-layer laminated ribbon 1 of regular cross-section particularly suited to be reinked and reused. The bottom, resistive layer 3 is a blend of polyimides with conductive, particulate graphite, which acts as a resistive layer. Resistive layer 3 is 0.3 mil in thickness (0.3 thousandth of an inch; 0.000762 centimeters). The next layer 5 is an 80 angstroms thick layer of silicon dioxide. The layer 7 next to the silicon dioxide is a stainless steel conductive and support layer 7. The conductive and support layer 7 is 0.5 mil in thickness (0.001270 centimeters). Finally, on the steel layer 7 is an ink layer 9 flowable in response to heat created by electric current applied from the outside of the resistive layer 3.

Printing is effected by known techniques in which the resistive layer 3 is contacted with point electrodes, such as electrodes 16 in U.S. Pat. No. 4,345,845 to Bohnhoff et al, which is illustrative of pertinent, known printing techniques. The resistive layer 3 or the steel layer 7 is contacted with a broad area electrode, such as collector contact 28 in the foregoing patent to Bohnhoff et al. The point electrodes (16 in the foregoing patent to Bohnhoff et al) are selectively driven in the form of the images desired with sufficient current to produce local heating which causes transfer of ink from ribbon 1 to a paper or other substrate (14 in the foregoing patent to Bohnhoff et al) in contact with the ribbon 1. The use of a blend of polyimide resins in the resistive layer 3 is the essential contribution of the invention to which the application entitled "Resistive Substrate for Thermal Printing Ribbons Comprising a Mixture of Thermosetting Polyimide, Thermoplastic Polyimide, and Conductive Particulate Material," described in the first paragraph of this application is directed. It provides an element having the necessary physical integrity and exceptionally good resistance to degradation during use in the thermal printing process. The element is strong and, where filled with graphite, has excellent abrasion resistance. The element has electrical resistivity well suited to thermal printing.

The stainless steel layer 7 provides physical strength, which is particularly important in the preferred embodiment since the ribbon 1 is intended to be used again and again. The steel layer 7 also is highly conductive and therefore provides a path of low electrical resistance from the area of the point contact electrodes to the broad area electrode. Accordingly, the area of primary electrical heat from current flow will be near the point electrodes. The use of steel or other metal as a thermal ribbon lamination and for these purposes forms no part of the contribution of this invention. The preferred embodiment steel is alloy 304, a chromium-nickel austenitic stainless steel.

The silicon dioxide layer 5, situated between the resistive layer 3 and the steel layer 7, is the essential contribution of this invention. Silicon dioxide generally is an electric insulator. The very thin layer 5 of silicon dioxide does conduct, but in a manner of a high resistance. Accordingly, much of the heat generated in the ribbon 1 during printing appears to be generated at the silicon dioxide layer 5 opposite each point electrode delivering current. This area is directly in contact with the steel layer 7, a good thermal conductor to the ink layer 9.

The ink layers 9 may be conventional. Two alternative embodiments will be described.

PROCESS OF MANUFACTURE

Resistive Layer Formula

The thermosetting polyimide: This material in the three formulas to be described is an ingredient of DuPont PI 2560, a trademark product of E. I. DuPont de Nemours Co. This is sold commercially as a solution described as 37±1.5% by weight solid precursor of polyimide, dissolved in about 47% by weight N-methyl-2-pyrrolidone (NM2P) and about 16% by weight xylene. It has a density of 1.43 grams per cubic centimeter, and the material polymerizes further after loss of the solvents at temperatures of 335° F. The final product is firm and massive, and does not soften appreciably at high temperatures.

The thermoplastic polyimide: This material in the three formulas to be described is XU 218, a trademark product of Ciba-Geigy Corp. It is sold commercially as an undiluted solid, which has a stretchable consistency after imbibing some solvent. It has a density of 1.2 grams per cubic centimeter, and is fully polymerized.

The graphite—This material is Micro 850, a trademark product of Asbury Graphite Mills, Inc. It has an average particle diameter of 0.50–0.60 microns. A typical formula in accordance with this invention will have graphite at a level somewhat near the 48% by volume figure which is the state of the art critical pigment volume concentration (CPVC) for graphite.

Vulcan XC 72—This is a conductive furnace carbon black, a trademark product of Cabot Corp.

SOTEX N—Trademark product of Morton Chemical Co., division of Morton-Norwich Products, Inc. A polar-solvent compatible dispersant.

Tetrahydrofuran (THF)—A solvent for the thermoplastic polyimide; compatible with the other ingredients, thereby serving as a diluent.

Preferred Formula

The following materials in the amounts shown were combined with stirring to disperse the graphite for 5 to 10 minutes in a high-speed mixer, cooled with a water jacket. The order is not essential and a full solution is readily achieved. Preferably, the thermoplastic polyimide is first solubilized in the tetrahydrofuran. The other ingredients are then added. Once mixed, further mixing appears detrimental.

The resistivity of the final layer 3 from this formula is in the order of magnitude of 1 ohm-cm.

| Component | Pbw | Density | Volume |
|---|---|---|---|
| XU 218 Thermoplastic Polyimide | 4.2 | 1.2 | 3.5 |
| PI 2560 Thermosetting Polyimide Precursor | 31.2 | — | — |
| N—methyl-2-pyrrolidone | 11.5 | 1.43 | 8.0 |
| Xylene | 14.7 | — | — |
| Micro 850 Graphite | 5.0 | — | — |
| Tetrahydrofuran | 22.9 | 2.2 | 10.4 |
| | 80 | — | — |

Earlier Formula—1 ohm-cm

This formula preceded the preferred formula and achieved a layer 3 having resistivity of about 1 ohm-cm, a characteristic believed to be near the low end of a range of operability in a thermal ribbon 1 of the general type described. The amounts shown were combined with stirring as described for the preferred formula.

| Component | Pbw | Density | Volume |
|---|---|---|---|
| XU 218 Thermoplastic Polyimide | 2.6 | 1.2 | 2.2 |
| PI 2560 Thermosetting Polyimide Precursor | 15.9 | — | — |
| N—methyl-2-pyrrolidone | 5.9 | 1.43 | 4.1 |
| Xylene | 7.5 | — | — |
| Micro 850 Graphite | 2.5 | — | — |
| Vulcan XC 72 Conductive Carbon Black | 35.1 | 2.2 | 15.9 |
| Tetrahydrofuran | 5.4 | 1.8 | 3.0 |
| N—methyl-2-pyrrolidone (Additional to PI 2560) | 90.0 | — | — |
| | 5.0 | — | — |

Earlier Formula—10 ohm-cm

This formula preceded the preferred formula and achieved a layer 3 having resistivity of about 10 ohm-cm, a characteristic believed to be near the high end of a range of operability in a thermal ribbon 1 of the general type here described. The amounts shown were combined with stirring as described for the preferred formula.

| Component | Pbw | Density | Volume |
|---|---|---|---|
| XU 218 Thermoplastic Polyimide | 8.4 | 1.2 | 7.0 |
| PI 2560 | 4.8 | — | — |
| Thermosetting Polyimide Precursor | 1.8 | 1.43 | 1.26 |
| N—methyl-2-pyrrolidone | 2.3 | — | — |
| Xylene | 0.7 | — | — |
| SOTEX N | 0.3 | 1.00 | 0.3 |
| Micro 850 Graphite | 20.6 | 2.2 | 9.4 |
| Tetrahydrofuran | 111.0 | — | — |
| N—methyl-2-pyrrolidone (additional to PI 2560) | 5.0 | — | — |

Stainless Steel

The stainless steel is commercially obtained in bulk amounts at the 0.5 mil (0.001270 cm) thickness. As so obtained, it has a clean, smooth surface.

Silicon Dioxide

The stainless steel is introduced into a vacuum-deposition chamber. One wide surface of the steel is presented to be coated. Standard procedures are followed. The chamber is evacuated and silicon dioxide is heated until it evaporates to a gas and then deposits on to the steel surface present. Deposition is terminated when the thickness is 80 angstroms. The chamber is a standard, commercially available device in which material to be evaporated is heated by an electron beam. A standard, associated crystal monitor device is simultaneously coated and it produces a distinctive signal upon being coated to the designated thickness. This control is not thought to be particularly precise, and 80 angstroms should be understood as an order-of-magnitude dimension.

Resistive Layer Application

The steel is flattened on a sturdy, highly polished, flat surface, silicon dioxide side up. The preferred formula was applied and doctored to the desired 0.3 mil (0.000762 cm) dry thickness by moving a coating rod having an external wire wound in a helix across the surface. The rod is sturdy stainless steel and the coating thickness is a function of material passed by the spacing between the helical ridges of the wire wrap. (The doctoring device used is a commercially obtained R.D.S. Laboratory Coating Rod No. 28, which provides a wet thickness of 2.52 mil [0.0064008 cm]). This material solidifies at ordinary room conditions in about one minute, primarily from loss of the highly volatile THF.

The steel as coated is then placed on a controlled heater in the nature of a griddle with the coated side up. It is first heated for 15 minutes at 176° F. (80° C.). Then, on the same or a second griddle heater, the coated plate is similarly subjected to heating for 15 minutes at 248° F. (12° C.). Then, the heating is similarly applied for 15 minutes at 320° F. (160° C.). At this point, the coating appears free of all dispersants, which have been expelled by the heat. Heat is then applied in the same manner for 1 hour at 335° F. (about 168° C.), which is effective to polymerize the precursor of polyimide to the polyimide.

After cooling, the steel has the then finished resistive layer 3 adhering to the silicone dioxide intermediate layer 5.

Ink Layer Formulations

One ink layer formula is applied as a melted liquid and the other is applied as a dispersion in solvent. At room temperature, the ink is a solid. The ink formulation is not an essential contribution of this invention. Nevertheless, Ink Formula 1 below is the inventive contribution of the inventor of the application entitled "Resistive Substrate for Thermal Printing Ribbons Comprising a Mixture of Thermosetting Polyimide, Thermoplastic Polyimide, and Conductive Particulate Material" described in the first paragraph of this application.

Each of the following two formulations have different characteristics as described and are generally equally preferred since adequate embodiments of this invention may employ inks having various characteristics.

Both formulas satisfy the following minimum criteria for inks for the thermal ribbon 1 involved. (1) Solid at room temperature; (2) Strong as solid (optional depending upon use in given reinking system); (3) Homogeneous as solid; (4) Reproducible melting point (in the general range of 70° C. to 100° C.); (5) Rapidly produced low viscosity near melt temperature (in the general range between 1 and $10^3$ cps); (6) Homogeneous as a liquid; (7) Feed well and rapidly through applicator (optional depending upon inking or reinking conditions and type of applicator); (8) Uniformly coats metal in thin film (about 0.2 mil or more); (9) Releases from metal or other substrate during printing; (10) Jet black with high optical density; and (11) Smudge resistant as printed characters.

The following formula, Ink Formula 1, functions as an interactive combination to achieve the foregoing objectives. In this formula the sucrose acetate isobutyrate appears to make the following contributions: (1) Provides abrupt change in viscosity with temperature; (2) Provides stability during heat exposure; (3) No vaporization during heating; (4) At melt temperature, high solvent action on ethyl cellulose, enhancing compatibility and functionality of the ink; (5) Very high gloss and good adhesion to paper; (6) Suitable to low viscosity inks; (7) Compatible with liquid stearic acid; and, (8) Provides lower melting inks than ink of the type of Ink Formula 2 below. Also, absence of the sucrose acetate isobutyrate results in poor wetting of the metallic substrate.

In this formula the ethyl cellulose appears to make the following contribution: (1) Binder for carbon black thereby improving smudge resistance; and (2) Highly compatible with sucrose acetate isobutyrate and stearic acid. This compatibility is a unique property and directly improves ink deposition and flow from certain applicators. In the absence of ethyl cellulose the ink viscosity would be significantly higher. The ethyl cellulose employed in Hercules Incorporated N-10. The N denotes an ethoxyl content of 47.5–49.0%. The 10 denotes viscosity in centipoises for a 5% concentration when dissolved in 80:20 toluene:ethanol and measured at 25±0.1° C.

In this formula the stearic acid appears to make the following contribution: (1) Lowers the viscosity of the ink (stearic acid alone is about 1 cps at melt temperature of the ink); (2) Amenable to low viscosity inks; (3) Compatible with sucrose acetate isobutyrate and ethyl cellulose; and, (4) Lowers the melting point of the ink. In the absence of stearic acid, the higher viscosity results in a tacky ink. Other fatty acids or their derivatives, for example glycerol monostearate and fatty acid amides, may be substituted.

| Ink Formula 1 | | | |
|---|---|---|---|
| Component | Pbw | Density | Volume |
| Sucrose Acetate Isobutyrate | 9.3 | 1.15 | 8.1 |
| Ethyl Cellulose (Hercules Inc. N-10) | 1.2 | 1.14 | 1.1 |
| Carbon Black | 1.3 | 1.8 | 0.7 |
| Stearic Acid | 6.0 | 0.839 | 7.2 |

This ink formula is particularly well suited to being deposited as a hot melt during bulk manufacturing or at a printer station adapted to use the ribbon 1 repeatedly.

| Ink Formula 2 | |
|---|---|
| | % By Weight |
| Versamid 871 (Henkel Corp. polyamide resin) | 18 |
| Furnace Carbon Black | 2 |
| Triphenyl Phosphate | 2 |
| Isopropyl Alcohol | 78 |

This is a typical formula for inks developed prior to this invention primarily for a single-use thermal ribbon. The formula is applied as a liquid and the isopropyl alcohol driven off by forced hot air drying. (Alternatively, 60 parts by weight Versamid 940 polyamide resin is added to 8.9 parts by weight carbon black and dispersed in isopropyl alcohol. The alcohol is expelled before any coating step and all coating is by hot melt.)

When used to reink a reusable ribbon 1 at the typing station in accordance with this invention, it is applied by being melted. Where the reinking apparatus requires the characteristic of ready flow described in connection with Ink Formula 1, that formula would be used.

Typically even when ribbon 1 is to be reinked at the typing station, a transfer layer 9 is applied during bulk manufacture. When the layer 9 is Ink Formula 1, it is applied as a hot melt, doctored to yield solid thickness of 0.2 mil (about 0.000508 centimeters), and allowed to cool. When the layer 9 is from Ink Formula 2, it is applied as a dispersion, doctored to yield a dry thickness of 0.2 mil (about 0.000508 centimeters), and the alcohol is driven off by forced air heating.

The bulk ribbon is then slit to the width required for the printer with which it is to be used. Typically, where the ribbon 1 is to be used a single time and discarded, it is wound into a spool and may be encased in a cartridge which fits the printer. The preferred embodiment of this invention has the strength and temperature resistance well suited for reinking and is primarily intended for that purpose. It may be joined in an endless band by abuting ends of the steel and welding or the like. It may also be coiled in a spool, although typically not one as large as for a one-use ribbon 1, and pulled back and forth indefinitely across the printing station while being reinked in the printer at a station spaced from the printing station.

Use of the Ribbon

A one-use ribbon 1 in accordance with this invention is used conventionally. Current is applied to the resistive layer 3 in the pattern of the character or shape being printed while the ribbon 1 is continually advanced during printing. When the ribbon 1 has been used once, it is replaced.

A reinked ribbon 1 is printed from in the same manner, but it is used indefinitely. As the ribbon 1 passes the printing station, a part of the ribbon 1 passes a reinking station. Reinking would be by a hot melt application of ink followed by doctoring to the original or desired thickness and cooling to a solid. Preferably only a small amount of the ink would be heated while most of the ink would be stored as a solid until melted during use for reinking. The ink formula typically would be the same as originally applied to the ribbon 1. Tests have shown the preferred embodiment ribbon 1 to have excellent abrasion resistance to normal moving contact with a thermal print head.

It will be apparent that preferred form here disclosed can be varied without departing from the spirit and scope of this invention and that, accordingly, patent coverage should not be limited to the specific details disclosed.

What is claimed is:

1. A transfer medium for non-impact thermal transfer printing comprising a thermal transfer layer, a resistive layer, and a layer of silicon dioxide on said resistive layer between said resistive layer and said transfer layer.

2. The transfer medium as in claim 1 in which the thickness of said layer of silicon dioxide is in the order of magnitude of 80 angstroms.

3. The transfer medium as in claim 1 which comprises a layer of highly conductive material contacting said silicon dioxide layer.

4. The transfer medium as in claim 2 which comprises a layer of highly conductive material contacting said silicon dioxide layer.

5. The transfer medium as in claim 3 in which said layer of highly conductive material is a metal support layer.

6. The transfer medium as in claim 4 in which said layer of highly conductive material is a metal support layer.

7. The transfer medium as in claim 5 in which said resistive layer is a polyimide binder and an electrically significant amount of conductive, particulate material.

8. The transfer medium as in claim 6 in which said resistive layer is a polyimide binder and an electrically significant amount of conductive, particulate material.

9. A transfer medium for non-impact thermal printing comprising a resistive layer, a silicon dioxide layer contacting said resistive layer, and a highly conductive layer contacting said silicon dioxide layer on the side opposite said resistive layer.

10. The transfer medium as in claim 9 in which the thickness of said layer of silicon dioxide is in the order of magnitude of 80 angstroms.

11. The transfer medium as in claim 9 in which said highly conductive layer is metal.

12. The transfer medium as in claim 10 in which said highly conductive layer is metal.

13. The transfer medium as in claim 11 in which said metal is steel.

14. The transfer medium as in claim 12 in which said metal is steel.

15. The transfer medium as in claim 13 in which said resistive layer is a polyimide binder and an electrically significant amount of conductive, particulate material.

16. The transfer medium as in claim 14 in which said resistive layer is a polyimide binder and an electrically significant amount of conductive, particulate material.

17. The transfer medium as in claim 9 also comprising a heat-flowable marking material contacting said conductive layer on the side opposite said silicon dioxide layer.

18. The transfer medium as in claim 10 also comprising a heat-flowable marking material contacting said conducting layer on the side opposite said silicon dioxide layer.

19. The transfer medium as in claim 15 also comprising a heat-flowable marking material contacting said conductive layer on the side opposite said silicon dioxide layer.

20. The transfer medium as in claim 16 also comprising a heat-flowable marking material contacting said conductive layer on the side opposite said silicon dioxide layer.

21. A thermal transfer medium having metal layer, a silicon dioxide layer deposited from a gas state on said metal layer, and a resistive layer deposited on said silicon dioxide layer opposite said metal layer.

22. The transfer medium as in claim 21 in which the thickness of said silicon dioxide layer is in the order of magnitude of 80 angstroms.

23. The transfer medium as in claim 21 in which the metal of said metal layer is steel.

24. The transfer medium as in claim 22 in which the metal of said metal layer is steel.

25. The transfer medium as in claim 21 also comprising a heat-flowable marking material contacting said conductive layer on the side opposite said silicon dioxide layer.

26. The transfer medium as in claim 22 also comprising a heat-flowable marking material contacting said conductive layer on the side opposite said silicon dioxide layer.

27. The transfer medium as in claim 23 also comprising a heat-flowable marking material contacting said conductive layer on the side opposite said silicon dioxide layer.

28. The transfer medium as in claim 24 also comprising a heat-flowable marking material contacting said conductive layer on the side opposite said silicon dioxide layer.

29. The transfer medium as in claim 21 in which said resistive layer is a polyimide binder and an electrically significant amount of conductive, particulate material.

30. The transfer medium as in claim 22 in which said resistive layer is a polyimide binder and an electrically significant amount of conductive particulate material.

31. The transfer medium as in claim 27 in which said resistive layer is a polyimide binder and an electrically significant amount of conductive, particulate material.

* * * * *